US006689021B2

(12) United States Patent
Stevens

(10) Patent No.: US 6,689,021 B2
(45) Date of Patent: Feb. 10, 2004

(54) ELLIPTICAL TRAINER

(76) Inventor: Clive Graham Stevens, 11F-2, No.43, Chai-I Street, Taichung City (TW)

( * ) Notice: Subject to any disclaimer, the term of this patent is extended or adjusted under 35 U.S.C. 154(b) by 0 days.

(21) Appl. No.: 10/191,865

(22) Filed: Jul. 10, 2002

(65) Prior Publication Data

US 2004/0009847 A1 Jan. 15, 2004

(51) Int. Cl.[7] ..... A63B 22/12; A63B 22/00
(52) U.S. Cl. ..... 482/52; 482/51
(58) Field of Search ..... 482/51–53, 57, 482/63, 70, 79–80

(56) References Cited

U.S. PATENT DOCUMENTS 5,529,555 A * 6/1996 Rodgers, Jr. ..... 482/57
5,653,662 A * 8/1997 Rodgers, Jr. ..... 482/52
5,879,271 A * 3/1999 Stearns et al. ..... 482/51
6,063,009 A * 5/2000 Stearns et al. ..... 482/52

* cited by examiner

*Primary Examiner*—Stephen R. Crow
(74) *Attorney, Agent, or Firm*—Charles E. Baxley

(57) ABSTRACT

An elliptical trainer includes a frame having a post with two handles pivotally connected to the post. A rotary member is rotatably connected to the frame and a first roller and a second roller eccentrically extend from each of two surfaces of the rotary member. Two pedals are respectively connected to the two handles and movably engaged with respective the two second rollers. Two cables each have a first end fixedly connected to respective one of the two pedals and a second end of each of the two cables reeves through respective one of the two first rollers and is connected to the frame.

10 Claims, 6 Drawing Sheets

ELLIPTICAL TRAINER

FIELD OF THE INVENTION

The present invention relates to an elliptical trainer wherein the pedals each have a shaft rolling on a roller which is eccentrically connected to a rotary member and two pivotal handles are connected to the pedals. Each pedal has a tension cable to maintain proper tension.

BACKGROUND OF THE INVENTION

Conventional elliptical trainers generally include a huge body with a crank rotatably connected to the body and two pedals are connected to the crank. Two handles are connected to the two pedals. The movement track of the pedals is not a smooth elliptical shape and when the pedals are moved to two extreme positions, the feet have to change direction so as to continue the cycle. The muscles of the user's feet are suffered by a sharp angle change and this could hurt the users. In other words, the track that the pedals of the conventional elliptical trainers is a flat oval track and this movement track is totally different from the normal way that people walk or run so that the users could be hurt at two peak positions of the oval track.

The present invention intends to provide an elliptical trainer that provides a smooth track of movement of the pedals so that the users' muscles will not be suffered by a sudden change.

SUMMARY OF THE INVENTION

In accordance with one aspect of the present invention, there is provided an elliptical trainer and comprises a frame having a post and two handles are pivotally connected to the post. A rotary member is rotatably connected to the frame and a first roller and a second roller eccentrically extend from each of two surfaces of the rotary member. Two pedals each have a first end thereof pivotally connected to respective one of the two handles and a second end of each of the two pedals is movably engaged with respective one of the two second rollers. Two cables each have a first end fixedly connected to respective one of the two pedals and a second end of each of the two cables reeves through respective one of the two first rollers and is connected to the frame.

The primary object of the present invention is to provide an elliptical trainer wherein the pedals each have a shaft movably engaged with the respective one of two rollers and the movement of the pedals are smooth.

The present invention will become more obvious from the following description when taken in connection with the accompanying drawings which show, for purposes of illustration only, two preferred embodiments in accordance with the present invention.

BRIEF DESCRIPTION OF THE DRAWINGS

FIG. 1 is a perspective view to show an elliptical trainer of the present invention;

DETAILED DESCRIPTION OF THE PREFERRED EMBODIMENTS

Figure 3:
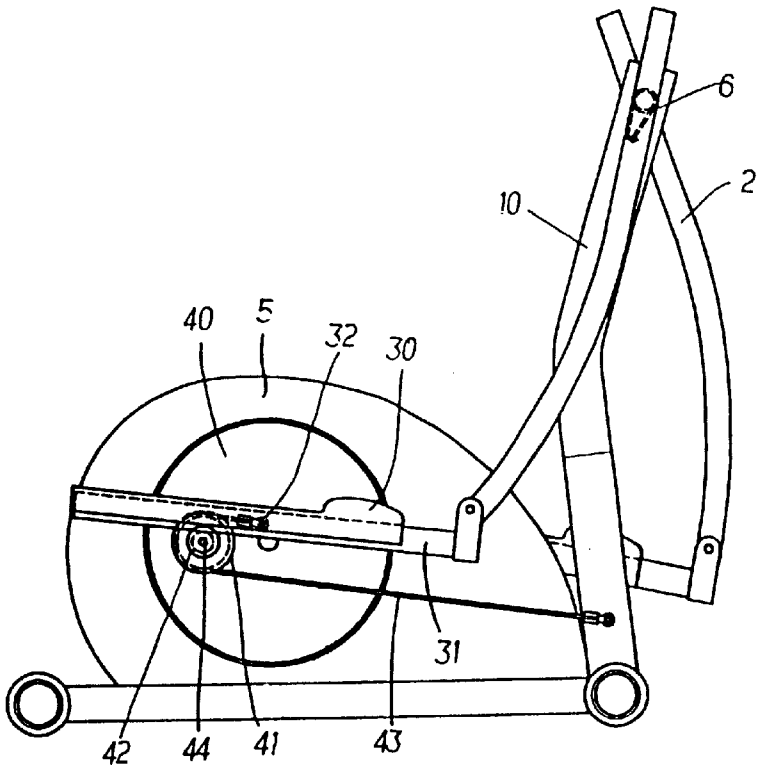
FIGS. 2 and 3 respectively show that the two pedals of the elliptical trainer of the present invention are located to 0 degree and 180 degree positions.
Figure 2:
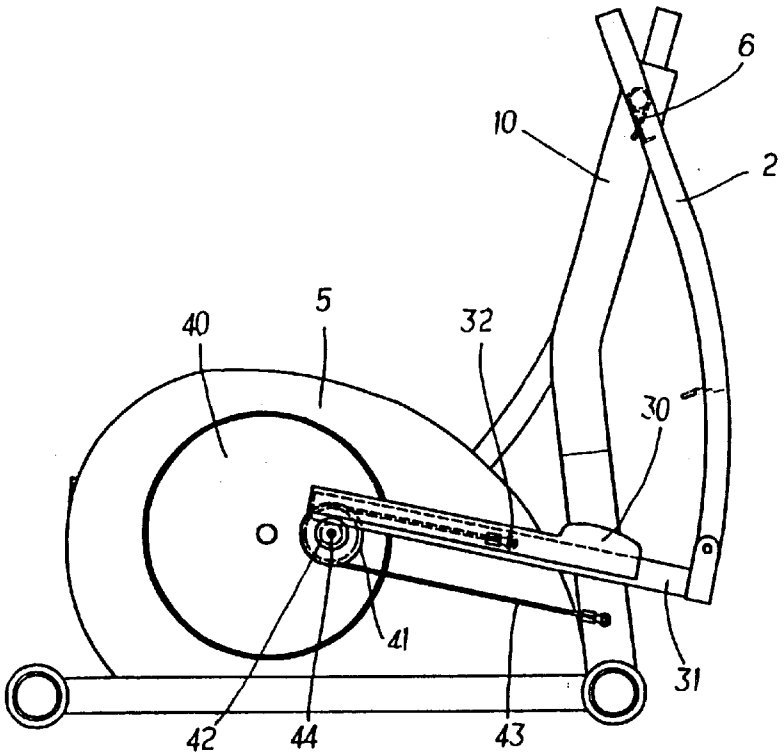
Figure 5:
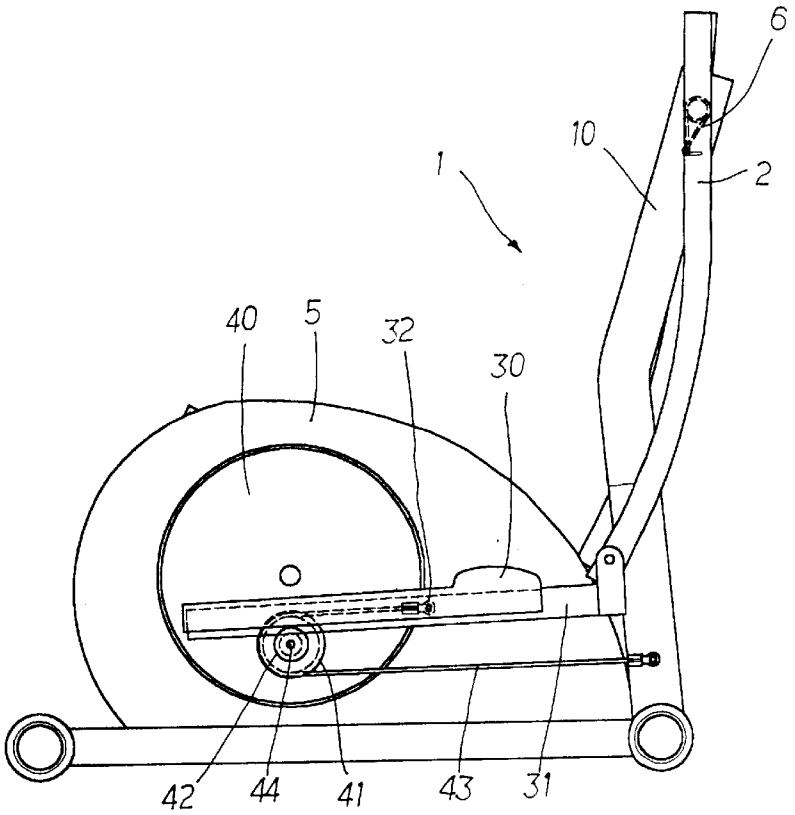
FIGS. 4 and 5 respectively show that the two pedals of the elliptical trainer of the present invention are located to 90 degree and 270 degree positions.
Figure 4:
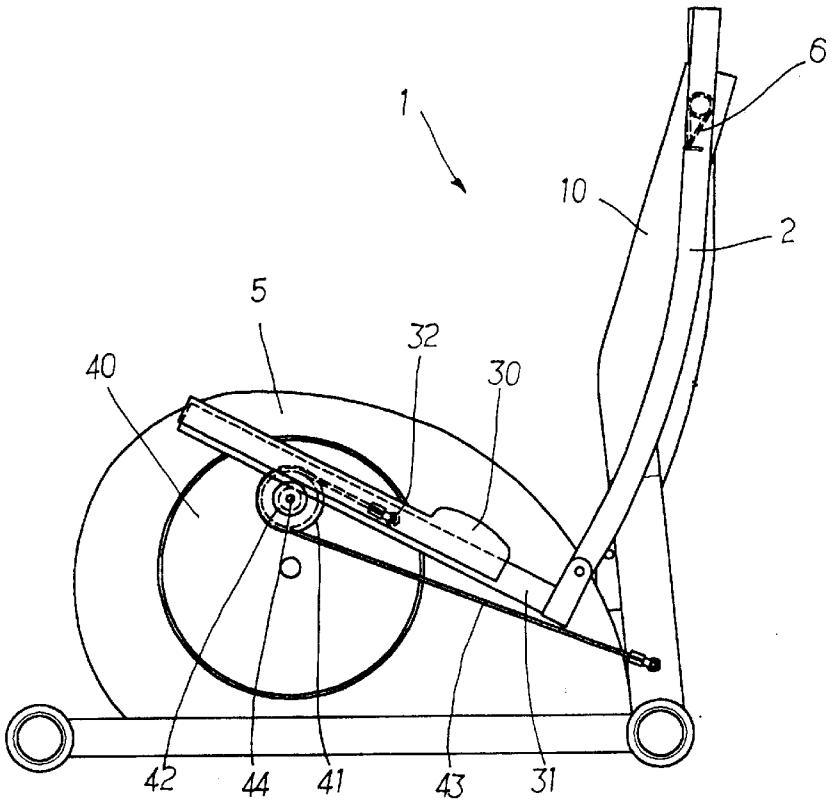

Referring to FIGS. 1 to 3, the elliptical trainer of the present invention comprises an I-shaped frame 1 which has a post 10 with two handles 2 pivotally connected to the post 10. Each of the handles 2 has a transverse bar on which a spring member 6 is secured and wrapped. An end of each of the springs 6 is fixedly connected to position 102 on the post 10. A rotary member 40 such as a wheel is rotatably connected to the frame 1 and a casing 5 is mounted to the rotary member 40, wherein the casing 5 has a hole 50 to receive the rotary member 40. A common shaft 44 extends eccentrically from each of two surfaces of the rotary member 40, and each of the common shafts 44 has a first roller 41 and a second roller 42 mounted thereto. Each of the first rollers 41 and the second rollers 42 has a groove 410/420.

Two pedals 30 each have a shaft 31 which has a first end pivotally connected to the respective one of the two handles 2 and a second end of each of the two shafts 31 is engaged with respective one of the grooves 420 of the second rollers 42. The shafts 31 are moved relative to the second rollers 42 when the second rollers 42 rotate.

Two cables 43 each have a first end fixedly connected to respective one of the two pedals 30 at position 32 and a second end of each of the two cables 43 reeves through respective one of the two first rollers 41 and is connected to the frame 1 at position 12 on the post 10.

As shown in FIGS. 2 and 3, and FIGS. 4 and 5, when stepping one of the pedals 30, the other pedal 30 is moved because the pedals 30 are engaged with the second rollers 42 on the rotary member 40. The shafts 31 are moved relative to the second rollers 42 when the second rollers 42 rotate so that the movement of the pedals 30 is smooth. When the pedals 30 are moved along with the rotation of the rotary member 40, the two handles 2 are swung. The spring members 6 and the cables 43 maintain a proper tension force for the movement of the pedals 30 and the handles 2. The pedals 300 are allowed to be pivoted about the second rollers 42 and are moved relative to the second rollers 42 so that the movement of the pedals 30 are natural and smooth as the users are walking or running.

Figure 6:
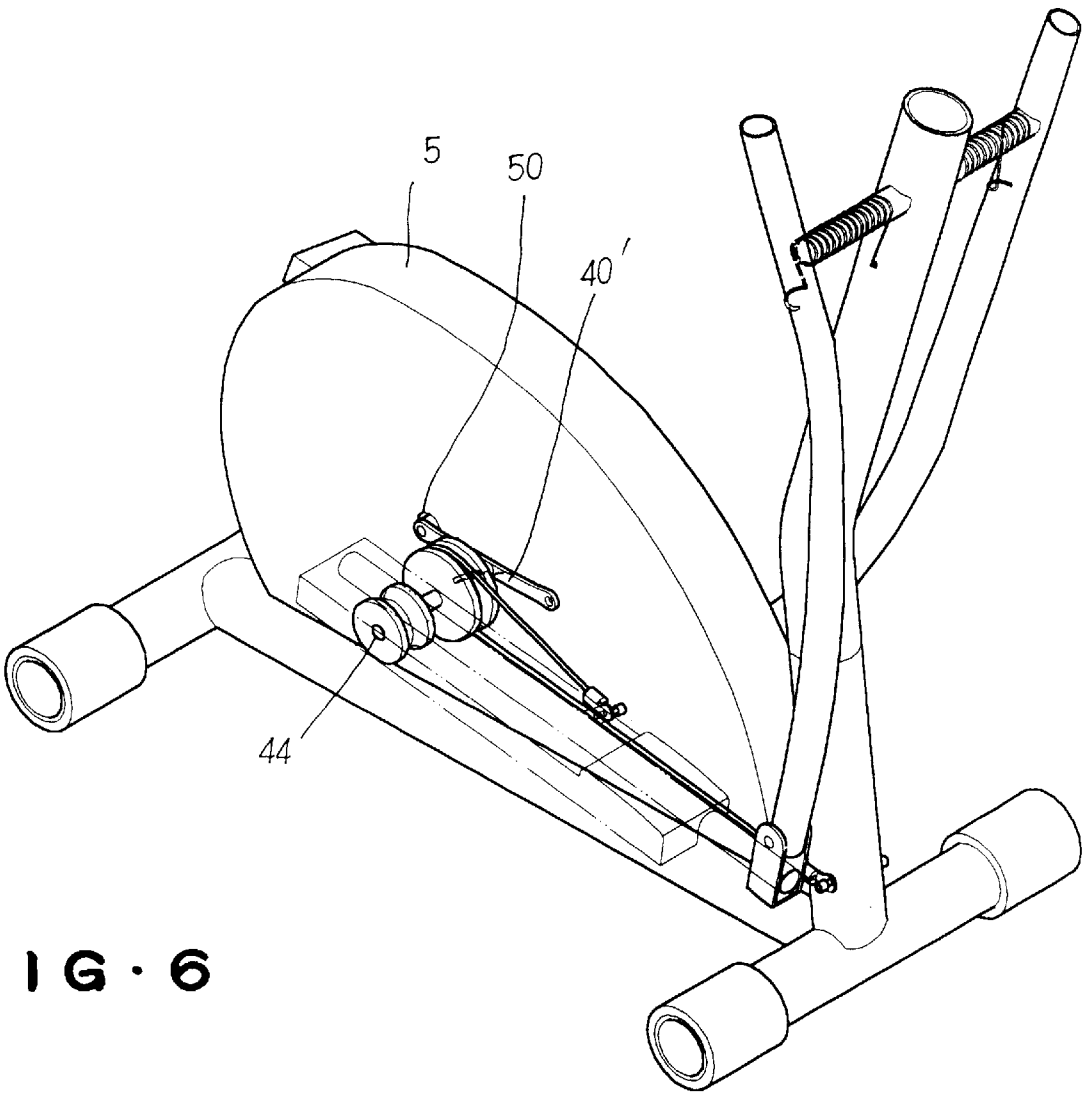
FIG. 6 shows another embodiment of the elliptical trainer of the present invention.
Figure 7:
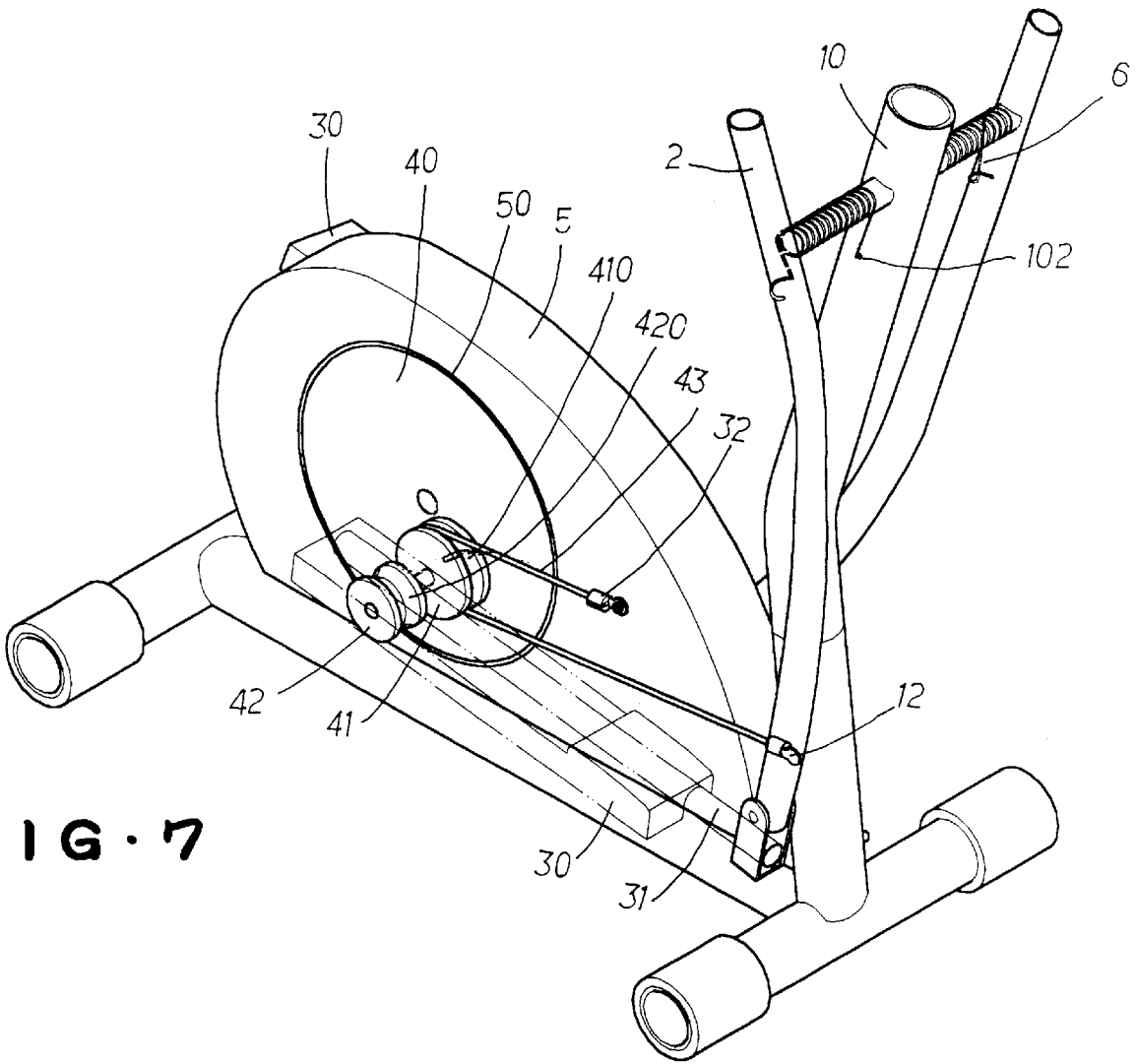

The rotary member can be a crank 40' as shown in FIG. 6, the crank 40' extends through the hole 50 in the casing 5 and the common shafts 44 respectively connected to two crank arms of the crank 40'.

Figure 7:
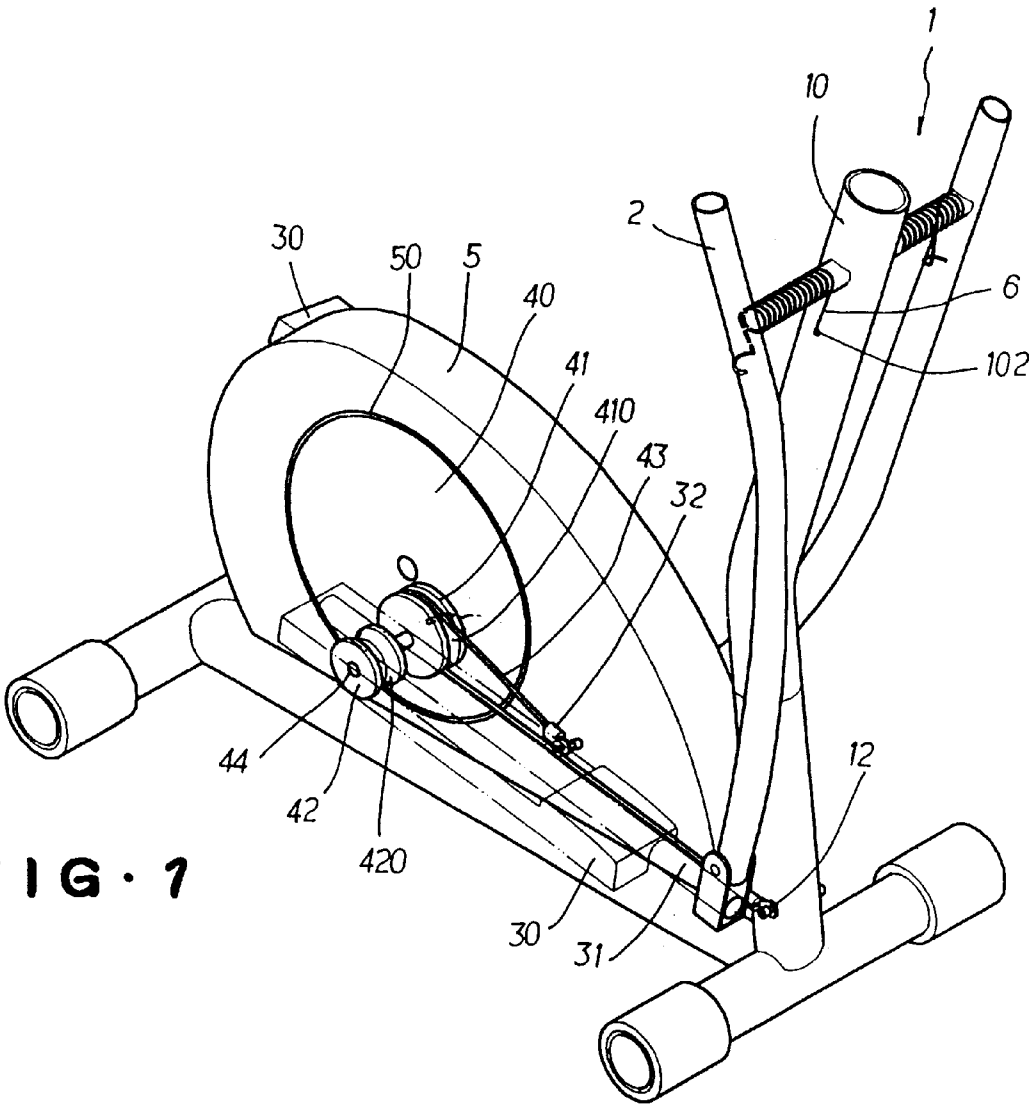
FIG. 7 shows yet another embodiment of the elliptical trainer of the present invention.
Figure 8:
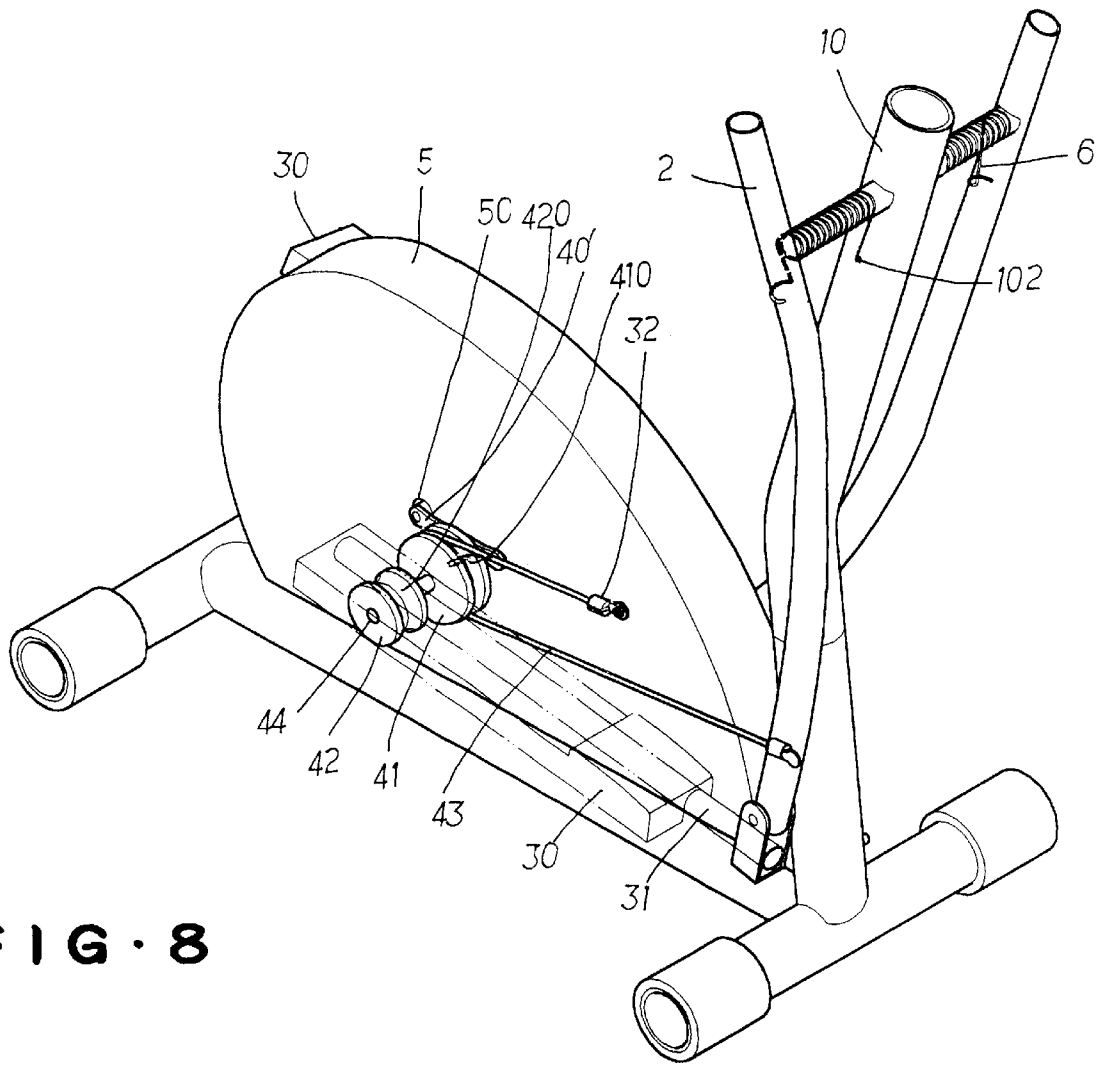
FIG. 8 shows another embodiment of the elliptical trainer of the present invention.

FIGS. 7 and 8 show that the first end of each of the cables 43 can be fixed on the casing 5 and the second end of each of the cables 43 is connected to the handle 2.

While we have shown and described the embodiments in accordance with the present invention, it should be clear to those skilled in the art that further embodiments may be made without departing from the scope of the present invention.

What is claimed is:

1. An elliptical trainer comprising:

a frame having a post with two handles pivotally connected to said post, a rotary member pivotally connected to said frame and a first roller eccentrically extending from each of two surfaces of said rotary member, a second roller connected to each of the first rollers; said first roller and said second roller mounted on a common shaft which extends eccentrically from said rotary member;

two pedals each having a first end thereof pivotally connected to respective one of said two handles and a second end of each of said two pedals movably engaged with respective one of said two second rollers, and two cables each having a first end fixedly connected to respective one of said two pedals and a second end of each of said two cables receiving through respective one of said two first rollers and fixedly connected to said elliptical trainer.

2. The elliptical trainer as claimed in claim 1, wherein each of said first rollers and said second rollers has a groove, said two pedals each having a shaft which is engaged with respective one of said grooves of said second rollers, said two cables received in said grooves of said two first rollers.

3. The elliptical trainer as claimed in claim 1 wherein said rotary member is a wheel.

4. The elliptical trainer as claimed in claim 1 wherein said rotary member is a crank.

5. The elliptical trainer as claimed in claim 1, wherein each of said two handles has a first end of a spring member connected thereto and a second end of each of said spring members is connected to said post.

6. An elliptical trainer comprising:

a frame having a post with two handles pivotally connected to said post, a rotary member pivotally connected to said frame and a first roller eccentrically extending from each of two surfaces of said rotary member, a second roller connected to each of the first rollers; said first roller and said second roller mounted on a common shaft which extends eccentrically from said rotary member;

two pedals each having a first end thereof pivotally connected to respective one of said two handles and a second end of each of said two pedals movably engaged with respective one of said two second rollers, and two cables each having a first end fixedly connected to respective one of said two pedals and a second end of each of said two cables receiving through respective one of said two first rollers and connected to respective one of said two handles.

7. The elliptical trainer as claimed in claim 6, wherein each of said first rollers and said second rollers has a groove, said two pedals each having a shaft which is engaged with respective one of said grooves of said second rollers, said two cables received in said grooves of said two first rollers.

8. The elliptical trainer as claimed in claim 6 wherein said rotary member is a wheel.

9. The elliptical trainer as claimed in claim 6 wherein said rotary member is a crank.

10. The elliptical trainer as claimed in claim 6, wherein each of said two handles has a first end of a spring member connected thereto and a second end of each of said spring members is connected to said post.

* * * * *